United States Patent [19]

Balister

[11] Patent Number: 4,753,155

[45] Date of Patent: Jun. 28, 1988

[54] AMMUNITION BOX FOR MACHINE GUN

[76] Inventor: Albert M. Balister, 835 Gadwell Ct., Virginia Beach, Va. 23462

[21] Appl. No.: 10,744

[22] Filed: Feb. 4, 1987

[51] Int. Cl.[4] ..... F41D 10/14

[52] U.S. Cl. ..... 89/34

[58] Field of Search ..... 89/33.1, 33.14, 33.16, 89/33.17, 34; 206/3

[56] References Cited

U.S. PATENT DOCUMENTS

| | | | |
|---|---|---|---|
| 1,213,755 | 1/1917 | Davies | 206/3 |
| 2,710,561 | 6/1955 | Dowd | 206/3 |
| 3,969,981 | 7/1976 | Brandstatter et al. | 89/33.02 |
| 3,974,739 | 8/1976 | Bourlet | 206/3 |
| 3,985,060 | 10/1976 | Conly | 89/34 |
| 4,004,683 | 1/1977 | Pomeroy et al. | 206/3 |
| 4,445,419 | 5/1984 | Fischer | 89/33.02 |
| 4,457,208 | 7/1984 | Golden | 89/33.02 |

FOREIGN PATENT DOCUMENTS

| | | | |
|---|---|---|---|
| 557182 | 5/1957 | Belgium | 89/34 |

OTHER PUBLICATIONS

Webster's New International Dictionary of the English Language, 1941, p. 2835.

The American Heritage Dictionary, Second College Edition, 1982, p. 1344.

*Primary Examiner*—Stephen C. Bentley

*Attorney, Agent, or Firm*—Buell, Ziesenheim, Beck & Alstadt

[57] ABSTRACT

An ammunition box for belt type ammunition is provided which is strong enough to support up to 300 rounds of ammunition and which delivers the ammunition directly to the feedtray of the weapon. A box constructed of stainless steel has a large trapezoidal notch in its upper surface. A pin traverses this notch and is connected to the box at both ends. Turnbuckles support the ammunition container by connecting this pin to the machine gun. The ammunition box has a vertically extending neck to which a pair of brackets are attached. The brackets secure the neck to the feedtray thereby providing a direct delivery of the belt of ammunition into the feedtray.

4 Claims, 1 Drawing Sheet

Fig. 2.
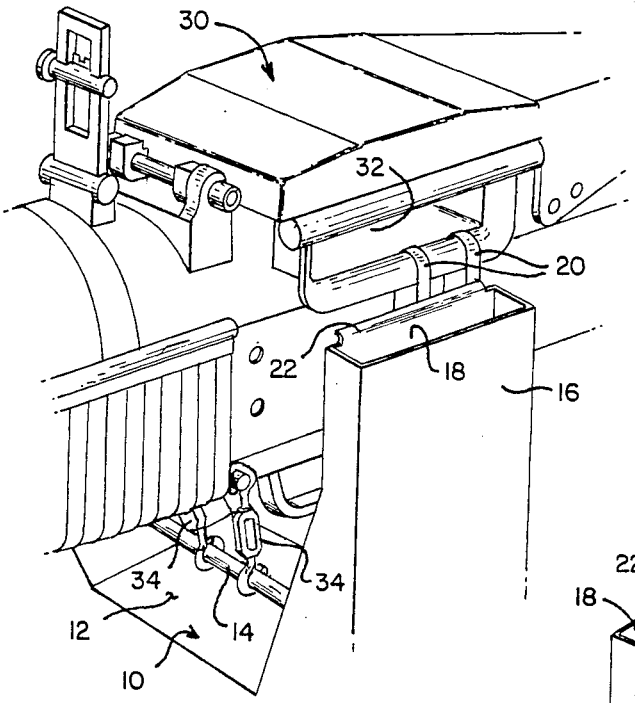
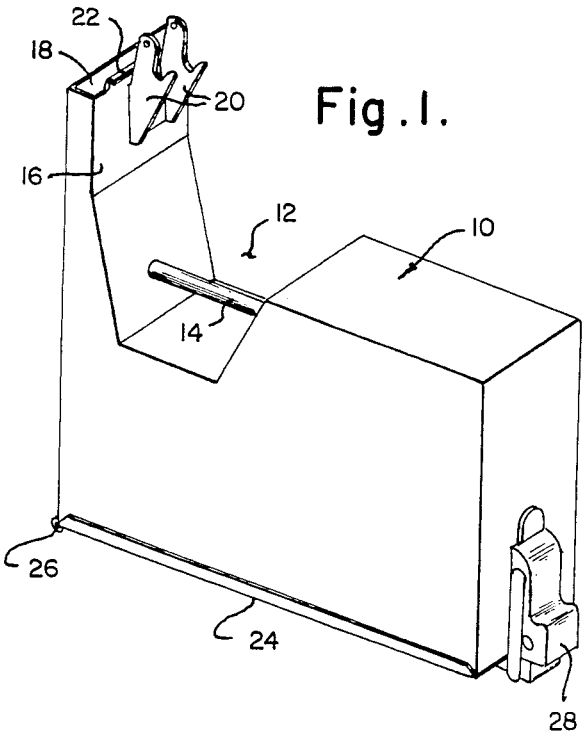
Fig. 1.
Fig. 3.
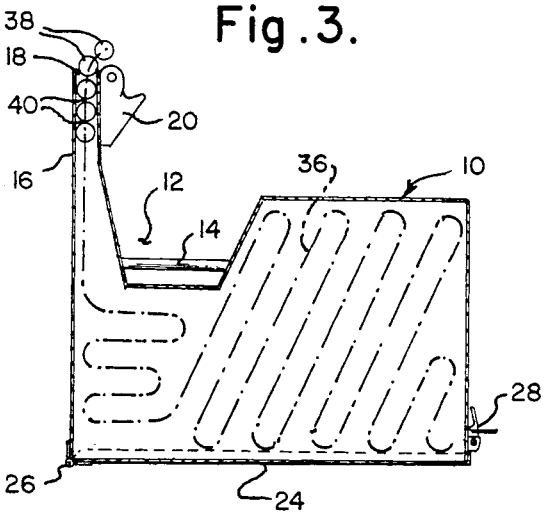

AMMUNITION BOX FOR MACHINE GUN

BACKGROUND OF THE INVENTION

1. Field of the Invention

This invention relates to improvements in the field of ammunition containers for portable weapons and, more specifically, to box type containers which hold belt ammunition for machine guns.

2. Description of the Prior Art

Ammunition containers generally come in one of two forms, a drum container which attaches to the top of a machine gun or a box type container which attaches underneath the weapon. Generally, the box type ammunition containers carry belt ammunition whereas the drum type magazines carry unlinked cartridges. This invention relates to the box type ammunition containers.

Current box type containers are of a simple cardboard construction having a cloth cover and a strap which attaches the container to the bottom of the machine gun. These ammunition boxes provide little protection to the contained rounds of ammunition. The cardboard box is not strong enough to protect the enclosed ammunition from chafing or other damage resulting from a fall or other collision involving the machine gun. Furthermore, this weakness of the cardboard box prohibits this type of ammunition container from carrying all but a limited amount of rounds of ammunition.

Another problem encountered during use of the cardboard ammunition box is the debris which can get caught in the belt resulting in damage to the links which connect the rounds of ammunition or to the rounds of ammunition themselves. Because the belt must travel outside the ammunition box before it enters the feedtray of the machine gun, a strong possibility of debris getting caught in the belt exists especially under combat conditions. Accordingly, there is a need for a box type ammunition container which is strong enough to carry and protect a sufficient number of enclosed rounds and is also able to deliver the belt of ammunition directly to the feedtray of the machine gun.

Various improvements have been suggested in the design of the ammunition boxes. Different materials, such as plastiglass, have been proposed for the construction of the box. However, use of these materials is also limited by the amount of ammunition which can be carried. Furthermore, these designs do not even attempt to resolve the problem of debris being caught in the belt when the belt leaves the ammunition box and proceeds to the feedtray.

SUMMARY OF THE INVENTION

This invention provides a belt ammunition box for portable weapons which is strong enough to carry approximately 300 rounds of ammunition and also strong enough in design to protect the rounds from damage due to falling or other collisions. The invention also delivers the belt directly from the container box into the feedtray of the machine gun.

A box constructed of stainless steel is provided which has a large trapezoidal notch on its upper surface. A pin connects both faces of the box on either side of this notch. Turnbuckles connect the pin to the weapon and secure the ammunition box in place under the weapon. A neck is provided on the upper portion of the ammunition box and has an opening therein. This neck extends to the feedtray of the machine gun when the ammunition box is secured to the gun. Brackets which attach to the top of the neck of the ammunition box secure the neck to the feedtray of the weapon. The bottom of the box is provided with a hinged end and a lock so that the container box can be easily loaded. In operation, the belt of ammunition proceeds from the container box, up the neck, and out the opening in the neck directly into the feedtray of the machine gun. In this manner, the chance of debris getting caught in the belt is dramatically reduced.

BRIEF DESCRIPTION OF THE DRAWINGS

FIG. 1 is an isometric view of the ammunition box provided in this invention.

FIG. 2 is an isometric view of the ammunition box shown in FIG. 1 as attached to the machine gun.

FIG. 3 is a longitudinal section of the ammunition box shown in FIG. 1, partially broken away.

DESCRIPTION OF THE PREFERRED EMBODIMENT

Referring to FIG. 1, ammunition box 10 has a general rectangular design. Trapezoidal notch 12 in the upper surface of ammunition box 10 provides space for pin 14. Pin 14 traverses notch 12 and is attached at both ends to ammunition box 10. Neck 16 is provided on one edge of the upper surface of ammunition box 10. Neck 16 extends vertically and ends at opening 18. Brackets 20 are attached to the upper portion of neck 16. Flange 22 curves inward along the inside portion of neck 16. The flat bottom surface 24 of ammunition box 10 is hinged at one end by means of a hinge 26. Locking mechanism 28 secures the bottom surface 24 of ammunition box 10 in a closed position.

Referring to FIG. 2, a portable machine gun 30, such as an M-60 machine gun used by the military, is shown which has a feedtray 32. Brackets 20 secure the neck 16 of the ammunition box 10 to the feedtray 32. Turnbuckles 34 attach at one end to pin 14 and at the other end to the machine gun 30. These turnbuckles 34 support the ammunition box 10 from the machine gun 30.

In operation, belts of ammunition 36, consisting of individual rounds of ammunition 38 and the interconnecting links 40, are loaded into ammunition box 10 by opening locking mechanism 28 of the bottom surface 24. The belts are loaded, and the locking mechanism 28 is secured. The lead round of ammunition proceeds up neck 16 and out opening 18. The belt of ammunition 36 follows and is directed by flange 22 into feedtray 32. Because neck 16 is directly beside feedtray 32, the possibility of debris being caught in the belts of ammunition 36 during combat and damaging the links 40 or rounds of ammunition 38 is greatly reduced. Because the ammunition box 10 opens directly beside feedtray 32, the maximum distance which the machine gun 30 has to pull the belt of ammunition 36 is roughly one foot. This cuts down on the weight pulling against the operation of feedtray 32, greatly increasing the performance of the machine gun 30.

Ammunition box 10 is constructed of stainless steel. This material provides sufficient strength such that the rounds of ammunition 38 contained in ammunition box 10 are not damaged by ordinary collisions or by the machine gun 30 falling. The strength of the stainless steel construction also allows for the carrying of 300 rounds of ammunition. This reduces the need for constant reloading of the ammunition box 10 during combat.

During combat, the ammunition box 10 can be reloaded and described above. However, should the immediacy of the situation dictate, belts of ammunition 36 can be loaded above ammunition box 10 directly into feedtray 32. Neither neck 16 nor brackets 20 of the ammunition box 10 will interfere with this action. Therefore, there is no need to detach the ammunition box 10 from machine gun 30 once the attachment has been made for combat.

While I have shown and described a present preferred embodiment of the invention and have illustrated a present preferred method of practicing the same, it is to be distinctly understood that the invention is not limited thereto but may be otherwise variously embodied and practiced within the scope of the following claims.

I claim:

1. A belt ammunition box for portable weapons comprising an ammunition box for holding the belt of ammunition, said box having a trapezoidal notch on its upper surface and a vertically extending neck attached on an upper edge thereof, said neck having an opening at the top thereof so that belts of ammunition may proceed from said ammunition box, up said neck and out said opening directly into the feedtray of said weapon and a pin which traverses said notch in said ammunition box and at least one turnbuckle which attaches at one end to said weapon and at the other end to said pin whereby said ammunition box is supported by said weapon, wherein said pin and said at least one turnbuckle act to attach said box to said feedtray of said weapon.

2. The belt ammunition box of claim 1 wherein brackets are attached at one end to said neck of said ammunition box and at the other end to said feedtray of said weapon.

3. The belt ammunition box of claim 1 wherein said weapon is an M-60 machine gun.

4. The belt ammunition box of claim 1 wherein all components of said ammunition box are constructed of stainless steel.

* * * * *

UNITED STATES PATENT AND TRADEMARK OFFICE

CERTIFICATE OF CORRECTION

PATENT NO. : 4,753,155

DATED : June 28, 1988

INVENTOR(S) : ALBERT M. BALISTER

It is certified that error appears in the above-identified patent and that said Letters Patent is hereby corrected as shown below:

Column 3, line 4, change "and" to --as--.

Signed and Sealed this

Twenty-ninth Day of November, 1988

*Attest:*

DONALD J. QUIGG

*Attesting Officer*

*Commissioner of Patents and Trademarks*